US008886024B2

(12) United States Patent
Tyburk

(10) Patent No.: US 8,886,024 B2
(45) Date of Patent: Nov. 11, 2014

(54) PORTABLE AIR CONDITIONING APPARATUS

(75) Inventor: Neil R. Tyburk, Canton, OH (US)

(73) Assignee: Suarez Corporation Industries, North Canton, OH (US)

( * ) Notice: Subject to any disclaimer, the term of this patent is extended or adjusted under 35 U.S.C. 154(b) by 752 days.

(21) Appl. No.: 13/150,610

(22) Filed: Jun. 1, 2011

(65) Prior Publication Data

US 2012/0308214 A1 Dec. 6, 2012

(51) Int. Cl.

| | |
|---|---|
| ***F24D 5/10*** | (2006.01) |
| ***F24H 3/06*** | (2006.01) |
| ***F24H 3/04*** | (2006.01) |
| ***F24F 13/20*** | (2006.01) |
| ***F24F 13/30*** | (2006.01) |
| ***F24F 1/00*** | (2011.01) |
| ***F24H 9/00*** | (2006.01) |
| ***F24H 9/02*** | (2006.01) |

(52) U.S. Cl.

CPC ..... *F24H 3/0411* (2013.01); *F24F 13/20* (2013.01); *F24F 13/30* (2013.01); *F24F 1/0007* (2013.01); *F24H 3/0417* (2013.01); *F24H 9/0063* (2013.01); *F24H 9/02* (2013.01); *F24F 2221/12* (2013.01)

USPC ..... 392/350; 392/347; 392/354; 392/356

(58) Field of Classification Search

None

See application file for complete search history.

(56) References Cited

U.S. PATENT DOCUMENTS

| | | | |
|---|---|---|---|
| 1,006,767 | A | 10/1911 | Mauger |
| 1,534,571 | A | 4/1925 | Conning |
| 2,379,705 | A | 7/1945 | Graves |
| 2,527,013 | A | 10/1950 | Kjelgaard |
| 2,919,338 | A | 12/1959 | Covault et al. |
| 3,575,582 | A | 4/1971 | Covault |
| 3,777,728 | A | 12/1973 | Reiche |
| 4,052,593 | A | 10/1977 | Ebert |
| 4,164,642 | A | 8/1979 | Ebert |
| 4,197,447 | A | 4/1980 | Jones |
| 4,307,284 | A | 12/1981 | Perron |
| 4,309,594 | A | 1/1982 | Jones |
| 4,680,448 | A | 7/1987 | Fester |
| 4,835,367 | A | 5/1989 | Hoffman |
| 4,900,898 | A | 2/1990 | Kling |
| 5,013,893 | A | 5/1991 | Goessler et al. |
| 5,157,239 | A | 10/1992 | Kanaya et al. |
| 5,568,586 | A | 10/1996 | Junkel |

(Continued)

FOREIGN PATENT DOCUMENTS

| | | | |
|---|---|---|---|
| GB | 2283810 | A | 5/1995 |
| JP | 53-13242 | A | 2/1978 |

(Continued)

OTHER PUBLICATIONS

International Search Report and Written Opinion issued Nov. 18, 2010 in PCT Application PCT/US2010/030202.

(Continued)

*Primary Examiner* — Thor Campbell

(74) *Attorney, Agent, or Firm* — Pearne & Gordon LLP

(57) ABSTRACT

An air conditioning apparatus is provided with an air plenum in fluid communication with an air inlet and an air outlet. A fan moves air through the air plenum. An interchangeable air conditioning core is removably installed within the air plenum and interposed between the air inlet and air outlet such that air moving along an air pathway is forced to proceed through the interchangeable air conditioning core.

29 Claims, 6 Drawing Sheets

(56) References Cited

U.S. PATENT DOCUMENTS

| | | | |
|---|---|---|---|
| 5,954,980 | A | 9/1999 | Westerberg et al. |
| 5,990,460 | A | 11/1999 | Petty et al. |
| 6,041,994 | A | 3/2000 | Hwang et al. |
| 6,297,481 | B1 | 10/2001 | Gordon |
| 6,327,427 | B1 | 12/2001 | Burkett |
| 6,745,758 | B1 | 6/2004 | Minidis |
| 7,046,918 | B1 | 5/2006 | Burkett et al. |
| 2002/0059782 | A1 | 5/2002 | Kadota et al. |
| 2010/0254686 | A1 | 10/2010 | Tyburk et al. |

FOREIGN PATENT DOCUMENTS

| | | | |
|---|---|---|---|
| JP | 57-21954 | U | 2/1982 |
| JP | 62-293029 | A | 12/1987 |
| JP | 2-282655 | A | 11/1990 |
| JP | 05-018611 | A | 1/1993 |
| JP | 7-42535 | U | 8/1995 |
| JP | 10-122664 | A | 5/1998 |
| JP | 10-253163 | A | 9/1998 |
| JP | 2002-81748 | A | 3/2002 |
| JP | 2005-024213 | A | 1/2005 |
| JP | 2007-309628 | A | 11/2007 |
| KR | 20-0215912 | Y1 | 3/2001 |
| KR | 20-2009-0002515 | U | 3/2009 |
| WO | 92/10709 | A1 | 6/1992 |
| WO | 2008/057321 | A2 | 5/2008 |

OTHER PUBLICATIONS

International Search Report and Written Opinion issued Jan. 12, 2012 in corresponding PCT Application Serial No. PCT/US2011/038717.

PORTABLE AIR CONDITIONING APPARATUS

CROSS-REFERENCE TO RELATED APPLICATIONS

Not applicable.

FIELD OF THE INVENTION

The present invention relates generally to an air conditioning apparatus, and more specifically, to a portable air conditioning apparatus.

BACKGROUND OF THE INVENTION

With the diminishing supply of fossil fuels and their associated spiraling costs, more homes and businesses are using a portable air conditioning apparatus to provide heating, ventilating, humidifying, and/or purification of local air. It is beneficial for such a portable air conditioning apparatus to be easy to service and thermally efficient.

BRIEF SUMMARY OF THE INVENTION

In accordance with one aspect of the present invention, an air conditioning apparatus comprises an exterior case comprising an air inlet and an air outlet and an air plenum disposed within the exterior case in fluid communication with the air inlet and air outlet and defining a primary air pathway and an independent secondary air pathway. A fan communicates with the air inlet for moving air through the air plenum, and an interchangeable air conditioning core is removably installed within the air plenum and interposed between the air inlet and air outlet such that air moving along the primary air pathway is forced to proceed through the interchangeable air conditioning core. An air jacket extends at least partially between the exterior case and the interchangeable air conditioning core, the air jacket being in fluid communication with the secondary air pathway.

In accordance with another aspect of the present invention, an air conditioning apparatus comprises an exterior case comprising an air inlet and an air outlet, and an air plenum disposed within the exterior case in fluid communication with the air inlet and air outlet and defining a primary air pathway. A fan communicates with the air inlet for moving air through the air plenum, and an interchangeable air conditioning core is removably installed within the air plenum and interposed between the air inlet and air outlet such that air moving along the primary air pathway is forced to proceed through the interchangeable air conditioning core. A removable access panel defines at least a portion of the air plenum, wherein an interior of said interchangeable air conditioning core is accessible by removing the access panel.

In accordance with another aspect of the present invention, an air conditioning apparatus comprises an exterior case comprising an air inlet and an air outlet, and an air plenum disposed within the exterior case in fluid communication with the air inlet and air outlet and defining a primary air pathway. A fan communicates with the air inlet for moving air through the air plenum, and an interchangeable air conditioning core is removably installed within the air plenum and interposed between the air inlet and air outlet such that air moving along the primary air pathway is forced to proceed through the interchangeable air conditioning core. A plurality of sources of thermal energy are installed within the interchangeable air conditioning core such that air moving along the primary airflow pathway is heated by the plurality of sources of thermal energy, wherein the plurality of sources of thermal energy are removable from the air plenum together with the interchangeable air conditioning core.

DESCRIPTION OF EXAMPLE EMBODIMENTS

Figure 1:
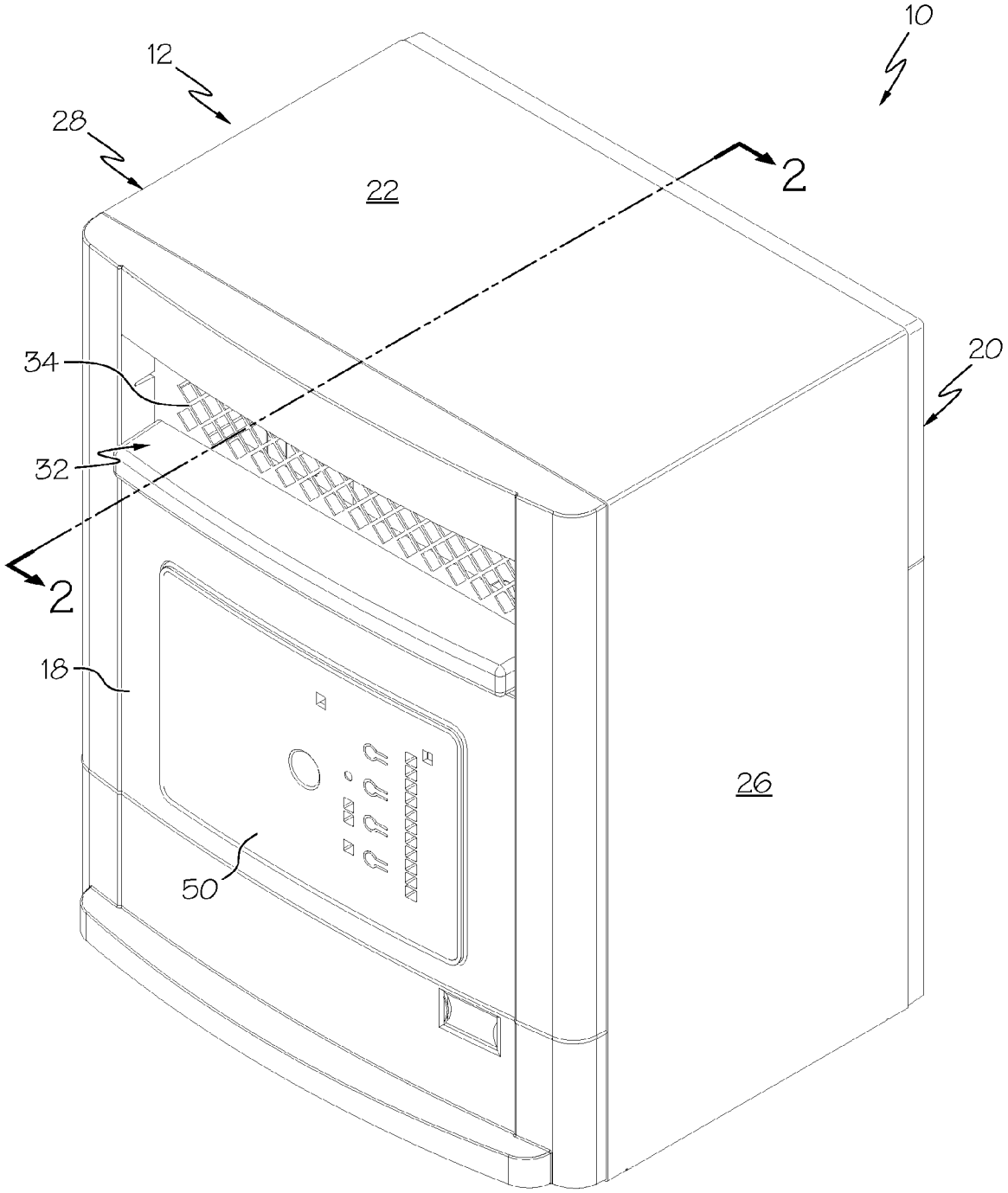
FIG. 1 is a perspective view of an example air conditioning apparatus.
Figure 2:
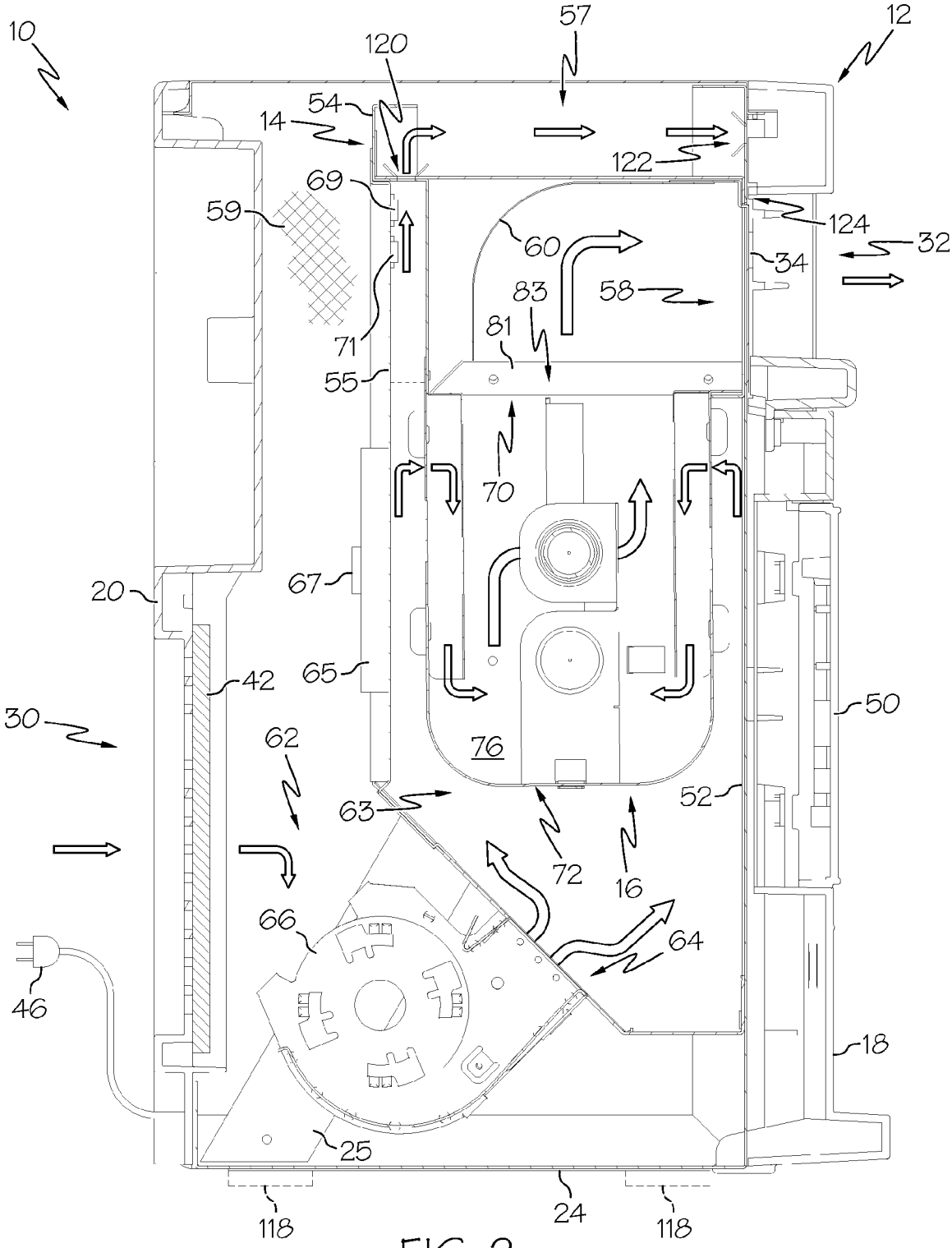
FIG. 2 is a side sectional view taken along line 2-2 of FIG. 1.

Turning to FIGS. 1 and 2, reference numeral 10 refers to an example portable air conditioning apparatus. Air conditioning apparatus 10 includes an exterior case 12, a conditioner core support 14 mounted inside exterior case 12 and an interchangeable air conditioning core 16 removably installed by conditioner core support 14. In the various examples described herein, the air conditioning apparatus 10 can include a wide variety of systems configured to condition (i.e., heat, cool, humidify, purify, etc.) air in various manners. In various non-limiting examples, as will be described herein, the air conditioning apparatus might include any or all of a heater, cooler, filter, source of ultraviolet (UV) radiation, humidifier, ion generator, various interconnecting ducting, dampers/valves, etc. The various components of the air conditioning system can be provided together as a single assembly that can be closely contained or even spread out through the air conditioning apparatus 10. Multiple air conditioning apparatuses 10 can also be utilized together to achieve a desired effect.

Where possible, the various structural elements can be coupled together by a minimal number of fasteners and joints, such as by a minimal number of screws or the like, projections received in slots, or other removable or even non-removable locking structure, for improved serviceability. Further, the air conditioning apparatus can include various other elements, such as described in U.S. Pats. Nos. 6,327,427 and 7,046,918, and pending application U.S. Ser. No. 12/755,746, the contents of which are incorporated herein by reference in their entirety.

Exterior case 12 can be a generally box-like structure including a front wall 18, a rear wall 20, a top wall 22, a bottom wall 24 and side walls 26, 28. An air inlet 30 is provided in rear wall 20 and an air outlet 32 is provided in front wall 18. Air inlet 30 and air outlet 32 can be covered with protective grilles, respectively. In addition or alternatively, a filter 42 can be positioned in at least a partially covering relationship over air inlet 30 and/or air outlet 32. For example, the filter 42 may be attached to rear wall 20 with various clips or fasteners, such as hook-and-loop style fasteners or the like. Filter 42 may be of conventional construction, for example fiberglass or equivalent material as is commonly used in furnace filters. In one example, the filter 42 can be a POLYTRON filter or similar.

Some or all of the walls, such as any of the front wall 18, top wall 22 and bottom 24 wall may be integrally formed as a wrapper to which side walls 26, 28 are formed with or joined with sheet metal screws, rivets, and/or by other conventional methods of construction such as welding, brazing and the use of fasteners, such a projection received in a slot, or combinations of methods as is known in the art. In one example, the top wall 22 and both side walls 26, 28 can be formed from a single sheet of material, which can be bent to define the top wall 22 and side walls 26, 28. In addition or alternatively, the air conditioning apparatus can be supported by one or more stationary or movable feet coupled to the bottom wall 24. In one example, shown optionally in phantom, the feet can be rotatable wheels 118, such as casters. The bottom wall 24 can include recesses, through holes, or the like to allow the casters to be at least partially recessed into the bottom wall 24 such that the air conditioning apparatus can be positioned relatively closer to a floor or other supporting surface. In one example, the rotatable wheels 118 can be coupled to the bottom wall 24 by mechanical fasteners, adhesives, welding, or even by a twist-lock arrangement.

Exterior case 12 generally encloses conditioner core support 14. Conditioner core support 14 can comprise a front mounting panel 52 and a rear mounting panel 54. In addition or alternatively, front mounting panel 52 may be spaced a distance from front wall 18, or may be directly adjacent thereto. For example, the front wall 18 can include a decorative plastic panel coupled to the mounting panel 52. The front mounting panel 52 can be secured to at least one of the top wall 22, bottom wall 24 and side walls 26, 28. In one example, front mounting panel 52 can be formed together with the bottom wall 24 (or even the top wall 22), such as being made out of the same sheet of metal, and may be bent relative to the bottom wall 24 so as to be generally perpendicular to the bottom wall 24 to facilitate manufacturing. Alternatively, front mounting panel 52 can be the same as the front wall 18. An aperture 58 is provided in front mounting panel 52 about which can be mounted a deflector shield 60 for directing air towards air outlet 32. The deflector shield 60 can be visible from the exterior of the unit, and can be colored or otherwise configured to be visually appealing.

In the shown example, the rear mounting panel 54 can be secured to or even formed with the front mounting panel 52. In another example, the rear mounting panel 54 can be secured to at least one of top wall 22, bottom wall 24 and side walls 26, 28 and can be spaced a distance from rear wall 20. In one example, the rear mounting panel 54 can be coupled to the bottom wall 24 by a mechanical fastener, such as a screw, rivet, or the like, and/or can also utilize a projection received in a slot for improved structural rigidity. In addition or alternatively, the rear mounting panel 54 can include at least one, such as a pair, of a reinforcing braces 25 coupled to the bottom wall 24. In another example, rear mounting panel 54 can be formed together with the bottom wall 24 (or even the top wall 22), such as being made out of the same sheet of metal, and may be bent relative to the bottom wall 24 so as to be generally perpendicular to the bottom wall 24 to facilitate manufacturing. In one example, all of the bottom wall 24, front mounting panel 52, and rear mounting panel 54 can be formed from a single sheet of metal.

The space between rear mounting panel 54 and rear wall 20 of exterior case 12 can form an intake chamber 62. A fan 66 provides airflow into the intake chamber 62. An interior space between the front and rear mounting panels 52, 54 can be further bounded by side panels 53 and a removable access panel 55 (see FIG. 3) to form an air plenum 63. The air plenum 63 defines a primary air pathway extending between the air inlet 30 and air outlet 32, as well as an independent secondary air pathway. The air conditioning core 16 is installed within the air plenum 63 and interposed between the air inlet 30 and air outlet 32 such that air moving along the primary air pathway is forced to proceed through the interchangeable air conditioning core 16. The air conditioning core 16 contains at least one air conditioning device arranged therein, such that air moving along the primary airflow pathway is conditioned by the at least one air conditioning device.

The air plenum 63, including the front and/or rear mounting panels 52, 54, could be removably or non-removably coupled to the frame (i.e., front wall 18, rear wall 20, bottom wall 24, etc.) in various manners, such as with sheet metal screws and/or by other conventional methods of construction such as welding, brazing and/or the use of fasteners, such a projection received in a slot, or combinations of methods as is known in the art. The air plenum 63 is in communication with the fan 66 via at least one aperture 64 for providing fluid communication between the fan 66 and the air conditioning core 16. For example, the fan 66 can be mounted to the air plenum 63 about the aperture 64 for drawing air into air conditioning apparatus 10 though air inlet 30 in rear wall 20 and forcing air out through the air conditioning core 16 (via aperture 58) and out the air outlet 32. Additionally, at least a portion of the airflow moving though the air plenum 63 can pass into the air jacket via the openings 120. Alternatively, the fan 66 may be located proximate the air inlet 30, to draw air in through that opening and direct it through the intake chamber 62 and into the air conditioning core 16. Various fans operated at various speeds can be used, including axial, centrifugal, cross-flow, etc.

The interchangeable air conditioning core 16 is removably installed within the air plenum 63. As described, the removable access panel 55 can define at least a portion of the air plenum 63, such that removal of the access panel 55 can provide service access into the interior of the air plenum 63. The access panel 55 can be coupled to the conditioner core support 14 in various manners. In one example, the air plenum 63 can hang onto the rear mounting panel 54 by one or more projection-in-slot fasteners, and/or can also be coupled to the rear mounting panel 54 by screws or other mechanical fastener(s).

Figure 3:
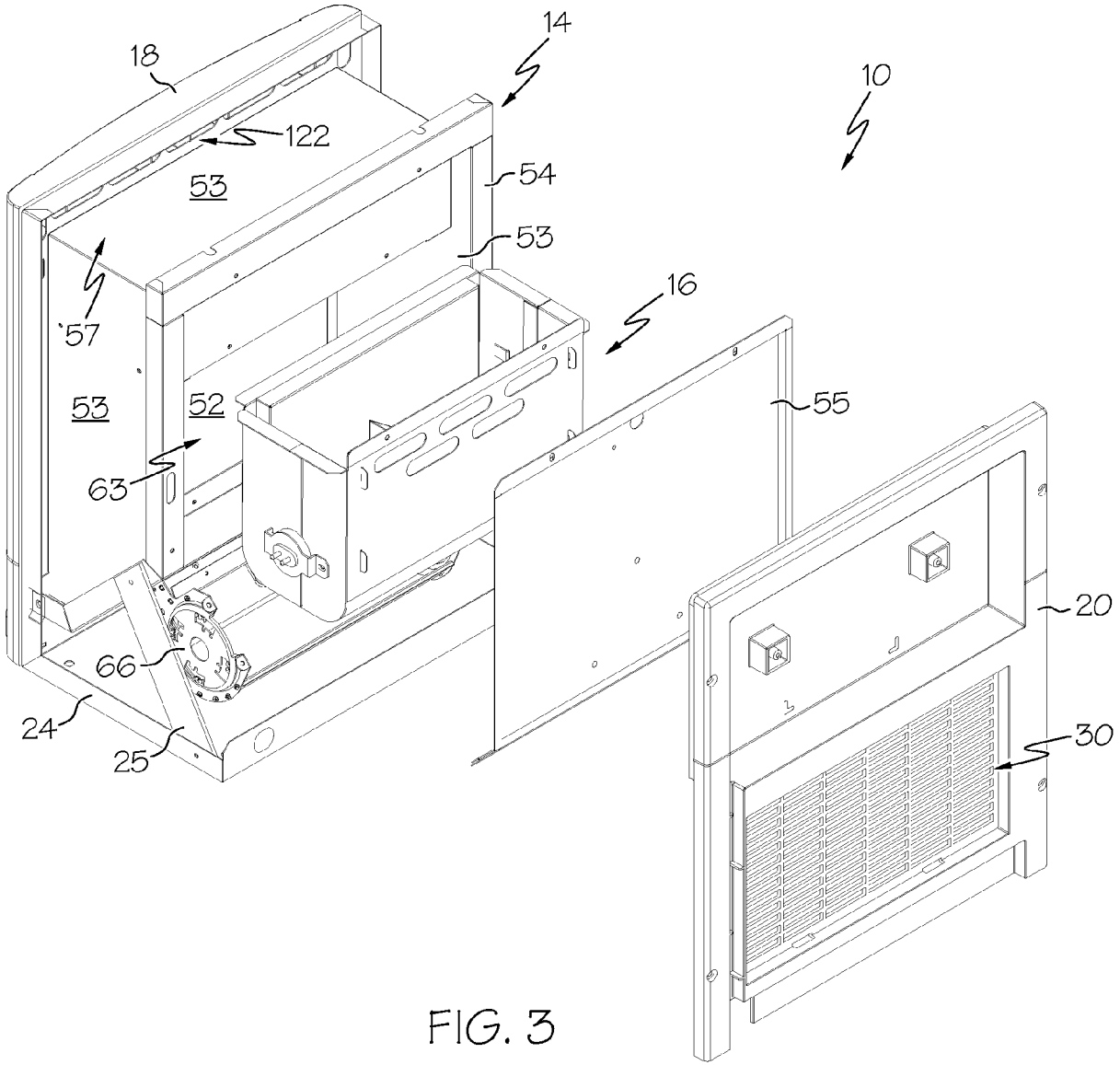
FIG. 3 is an exploded, perspective view of the air conditioning apparatus of FIG. 1.

Removal of the access panel 55 can provide service access to an interior of said interchangeable air conditioning core 16, such as to repair, replace, or otherwise maintain an air conditioning device contained therein. As shown in FIG. 3, removal of the access panel 55 can provide ready access to the interior of the air plenum 63 so that the interchangeable air conditioning core 16 can be easily removed therefrom. In one example, shown schematically in phantom in FIG. 2, the removable access panel 55 can be coupled to the interchangeable air conditioning core 16 such that removal of the removable access panel 55 thereby causes removal of the interchangeable air conditioning core 16 from said air plenum 63. Thus, the air conditioning core 16 can be at least partially retained by the access panel 55, and removal of the air conditioning core 16 can be simplified. The air conditioning core 16 can also be independently secured within the air plenum 63.

A conventional power cord 46 can extend from rear wall 20 for connecting the electrical components within exterior case 12 to a conventional 110 volt A.C. line. If desired, air conditioning apparatus may have a power cord strain relief or the like installed in the hole through which power cord 46 passes. In addition or alternatively, a variable thermostatic control 50 can be mounted to either or both of the front wall 18 (shown) or even to the rear wall 20 (not shown). The variable thermostatic control 50 can include analog and/or digital structure for adjusting an operational characteristic of an air conditioning device, such as a desired temperature or operational range (i.e., relatively hotter or cooler) and/or fan speed (i.e., relatively faster or slower), and may include various knobs, buttons, or other selector structure. In addition or alternatively, the thermostatic control 50 can include various circuitry, sensors, such as various temperature sensors, humidity sensor(s), etc., and/or timer(s). Similarly, the variable thermostatic control 50 can include indicia or other indicator structure to provide a visual and/or audible display of the desired settings/selections. Input/output structure, which may be located at a convenient location (e.g., on the front or sides) may be electrically coupled but physically located apart from control structure (e.g., circuitry, sensors, etc.) that may be located within the unit. Structure can be provided for a visual and/or audible display of service information, such as warnings, filter change notifications, air conditioning device replacement notifications, etc. Thermostatic control 50 communicates with the operative components of the air conditioning apparatus, such as the thermal energy source(s) and/or fan(s), to control operation thereof. An on-off switch (not shown) may be provided on front wall 18 or rear wall 20, if desired. An automatic-mode or manual-mode switch (not shown) may also be provided on front wall 18 or rear wall 20, if desired. A switch (not shown) may also be provided to operate the fan without the air conditioning device(s), so as to provide only air circulation.

In one embodiment of the air conditioning apparatus 10, one or more temperature sensors, which may also function as limit switches, can be provided about the air conditioning core 16. A control temperature sensor 67 can be located about, on, or in air conditioning core 16 to sense the air temperature inside the air conditioning core 16, such as in an embodiment where the air conditioning apparatus 10 includes a source of thermal energy (i.e., a heater). In one example, the control temperature sensor 67 is disposed close to the rear mounting panel 54 (or even the front mounting panel 52) adjacent where air enters (or exits) air conditioning core 16, and acts as a fan control switch. In one example, the control temperature sensor 67 can be mounted on a circuit board 65 or the like. When the temperature in air conditioning core 16 rises above a predetermined temperature detected by the control temperature sensor 67, such as 110 degrees F., fan 66 is switched on. Delayed starting of fan 66 until after the thermal energy sources are energized can be preferred such that cold air is not forced through air outlet 32. The control temperature sensor 67 can act in reverse at the end of a heating cycle when air conditioning apparatus is shut off. In this mode, fan 66 continues to operate until the temperature drops below a predetermined temperature, such as 110 degrees F., improving the efficiency of the air conditioning apparatus by extracting residual heat.

A first temperature sensor 69 can be located to sense the air temperature inside the air conditioning core 16 at a different location than the control sensor 67 and can function as a safety switch or fuse. The first temperature sensor 69 can be located towards the top of the air conditioning core 16 and can be retained by a bracket. When the temperature in air conditioning core 16 rises above a first predetermined temperature detected by the first temperature sensor 69, such as 225 degrees F., the air conditioning device(s) (e.g., thermal energy sources) can be shut down as a safety feature while said control temperature sensor 67 keeps fan 66 running until the temperature in air conditioning core 16 falls below a predetermined temperature, such as 110 degrees F. The first temperature sensor 69 can be provided as a switch operable between on and off states, or as a one-time use fuse. In addition, a second temperature sensor 71 can also be provided to sense the air temperature inside the air conditioning core 16 at a different location than the first temperature sensor 69 and can function as an additional safety switch or fuse. The second temperature sensor 71 could be located near the first temperature sensor 69, and could even be retained by the same bracket, or separately. When the temperature in air conditioning core 16 rises above a second predetermined temperature detected by the second temperature sensor 71, such as 250 degrees F., the air conditioning device(s) (e.g., thermal energy sources) can be shut down as a safety feature while said control temperature sensor 67 keeps fan 66 running until the temperature in air conditioning core 16 falls below a predetermined temperature, such as 110 degrees F. The second temperature sensor 71 can be provided as a switch operable between on and off states, or as a one-time use fuse. The second predetermined temperature can be different, such as greater than, the first predetermined temperature. In one example, it can be beneficial to electrically couple the first and second temperature sensors 69, 71 in a series configuration to provide a redundant safety scheme. It can also be beneficial to provide one of the first and second temperature sensors 69, 71 as a switch, while the other is a fuse, though both can be similar types. It will be apparent that the temperatures at which the temperature sensors 67, 69, 71 operate are arbitrary and a matter of design choice. Other sensors may be used that are triggered at different temperature levels, times, etc.

This spacing of air plenum 63 from exterior case 12 provides an air jacket 57 that extends at least partially about the air conditioning core 16. The air plenum 63 can be supported at a distance below top wall 22 and above bottom wall 24 of exterior case 12 and a distance from side walls 26, 28. The air jacket 57 is in fluid communication with the secondary air pathway of the air plenum 63. In one example, the air jacket 57 can at least partially surround the air plenum 63. Air jacket 57 can insulate the exterior case 12 to inhibit, such as prevent, overheating. In addition or alternatively, some or all of the interior surface(s) of the exterior case 12 can include an insulating material 59 (shown schematically). For example, the interior surfaces of the top wall 22 and side walls 26, 28 can all include insulating material 59.

In addition or alternatively, the intake chamber and/or air plenum 63 may form a portion of the air jacket 57, and/or can provide similarly insulating functionality. As such, it is possible for air conditioning apparatus to be safely operated with the exterior case 12 remaining generally cool to the touch, and/or with exterior case 12 fitted into a wood cabinet or the like. In one example, the air jacket 57 can be in fluid communication with the air inlet 30 via at least one opening 120 in the rear mounting panel 54 (and/or air plenum 63), and the air outlet 32 via at least one opening 122 in the front mounting panel 52, to provide a cooling airflow through the air jacket 57. The air plenum 63 can be arranged in fluid communication with the opening(s) 120, 122 such that positive airflow from the fan 66 is caused to flow into and through the air jacket 57 during operation of the air conditioning apparatus. The airflow exiting the air jacket 57 via opening(s) 122 can proceed through at least one aperture 124. In one example, the aperture 124 can be a gap, such as a ⅛" clearance (or other dimension), located at the interface between the front wall 18 and the front mounting panel 52 and in flow communication with the air outlet 32. The aperture 124 can be formed (e.g., molded or otherwise manufactured) into either or both of the front wall 18 and front mounting panel 52. Thus, airflow exiting the opening(s) 122 can proceed through the aperture 124 to allow the air from the air jacket 57 to join and mix with the conditioned (e.g., heated) air exiting the air conditioning core 16 through air outlet 32.

As described herein, the air conditioning core 16 is installed within the air plenum 63 such that air moving along the primary air pathway is forced to proceed through the interchangeable air conditioning core 16. At least one air conditioning device is arranged within the air conditioning core 16, such that air moving along the primary airflow pathway is conditioned by the at least one air conditioning device. A wide variety of air conditioning devices can be provided to condition (i.e., heat, cool, humidify, purify, etc.) air in various manners. In various non-limiting examples, as will be described herein with later reference to FIG. 8, the air conditioning device(s) might include any or all of a heater, cooler, filter, source of ultraviolet (UV) radiation, humidifier, ion generator, various interconnecting ducting, dampers/valves, etc. Various numbers and/or combinations of air conditioning devices can be used.

Turning now to FIGS. 4-7, an example air conditioning core 16 will be more fully described. Air conditioning core 16 is removably mounted within the interior of the air plenum 63 and generally comprises an open top 70, a curved bottom wall 72, side walls 74, and end walls 76. The curved bottom wall 72, side walls 74, and end walls 76 can be formed together from a single piece of metal through various bending and/or deep draw methods, or can even be formed from a plurality of elements coupled together. The air conditioning core 16 further includes one or more flanges 75 (with or without seals) for installation within the air plenum 63. The air conditioning core 16 can be removably mounted within the air plenum 63 in various manners, including sheet metal screws, rivets, and/or by other conventional fasteners, such a projection received in a slot, or combinations of methods as is known in the art. The air conditioning core 16 could be coupled to the access panel 55 for removal therewith.

The air conditioning core 16 can have various geometries to guide the airflow therethrough. For example, the side walls 74 (and/or bottom wall 72, end walls 76) can include inlet aperture(s) 85 to permit airflow into the air conditioning core 16. It is understood that the aperture(s) 85 can be provided in both of the side walls 74. Various numbers and/or geometries of apertures 85 can be provided. Additionally, the air plenum 63 can include a dividing wall 81 disposed between air inlet 30 and air outlet 32. The dividing wall 81 can inhibit, such as prevent, fluid communication between the air inlet 30 and air outlet 32. However, dividing wall 81 can include one or more apertures 83 extending therethrough, and the air conditioning core 16 can be coupled to the dividing wall 81 with the open top 70 arranged in fluid communication with the aperture(s) 83. Thus, air moving along the primary air pathway from the air inlet 30 and towards the air outlet 32 is forced to proceed into the air conditioning core 16 via the apertures 85, and out of the air conditioning core 16 via the open top 70, in order to ultimately proceed through the dividing wall 81.

The example air conditioning core 16 will now be described with the air conditioning device including at least one source of thermal energy 78. For example, the source of thermal energy 78 can be an infrared emitter. Indeed, In the air conditioning core 16 shown in the drawings, mountings for two thermal energy sources 78 are provided with the energy sources 78 being mounted horizontally and between side walls 74 (see FIGS. 5 and 7). Horizontal mounting of energy sources 78 can be beneficial as this arrangement improves serviceability of the air conditioning apparatus 10 as will be further described.

Various example energy sources 78, such as radiant energy sources, can be utilized. For example, each thermal energy source 78 can comprise a high resistance wire wrapped in a helical configuration. The helically configured element is suspended within a quartz tube. The tube is capped with ceramic end pieces or caps 80. The tube may be vacuum sealed and may contain an inert gas. The quartz tube may be clear, semi-translucent or translucent. In a preferred embodiment, the thermal energy source 78 is linear and has a clear quartz tube. In one example embodiment, each of energy sources 78 is about 500 watts, where each source 78 draws about 4 amps. Thus, the total energy usage for operating the air conditioning apparatus is about 1000 watts so as to be operable on a standard household 110V A.C. outlet. Still, the thermal energy source 78 can have various geometries, such as curved, polygonal, random, etc.

Each energy source 78 can be inserted into the air conditioning core 16 via a hole 82 in the end walls 76, and can be supported within the air conditioning core 16 by a bracket 97 or the like. For example, the bracket 97 can be coupled to the bottom wall 72. One or more bracket(s) 97 can support the energy sources 78 via their caps 80. A single bracket 97 can support multiple energy sources 78, or multiple brackets 97 can also be used. Either or both of the caps 80 can be adapted to retain the thermal energy source 78 mounted through the holes 82 in various manners, such as via a snap-lock arrangement or the like. Thus, each cap 80 and source 78 can be designed to have a unique socket structure to facilitate replacement of a source 78 by a repair technician or even by the end-user. Electrically conductive wires can pass through the hole 82, or may be provided to either of the end caps 80, for energizing energy source 78. The electrically conductive wires can be pig-tailed at one end only to further facilitate the replacement of a source 78 by a repair technician or even by the end-user. For example, as shown in FIG. 7, one of the end caps 80 can have an electrical plug 89 adapted to fit into electrical socket structure to facilitate de-coupling each source 78 for replacement.

In addition or alternatively, a retaining plate 86 can also be provided to positively couple the energy source 78 to the air conditioning core 16. One end of the retaining plate 86 can be fit into a slot of the end wall 76. The one end of the retaining plate 86 can have a bent or curved profile to be coupled to the end wall 76 in a pivoting, cantilever fashion. For assembly, the energy source 78 can be inserted into the hole 82 in the end wall 76 of the air conditioning core 16 until one end cap 80 is received by the bracket 97. Next, the retaining plate 86 can be pressed down against the other end cap 80 to secure the energy source 78 to the end wall 76 of the air conditioning core 16. The retaining plate 86 can then be retained in place by removable coupling via a mechanical fastener (e.g., screw, bolt, nut, etc.) or the like. In one example, a single mechanical fastener can be used. The electrical plug 89 can remain accessible via the retaining plate 86 for connecting the electrically conductive wires. Disassembly can be performed in reverse. Moreover, because each energy source 78 (and/or other air conditioning device) is coupled to the air conditioning core 16, the energy sources 78 are removable from the air plenum 63 together as a modular unit with the interchangeable air conditioning core 16. With such structure, individual energy sources 78 can be quickly and easily replaced with little disassembly and few fasteners, such as by only removing the access panel 55, air conditioning core 16, and the retaining plate 86, as well as providing easy manufacturing.

Figure 7:
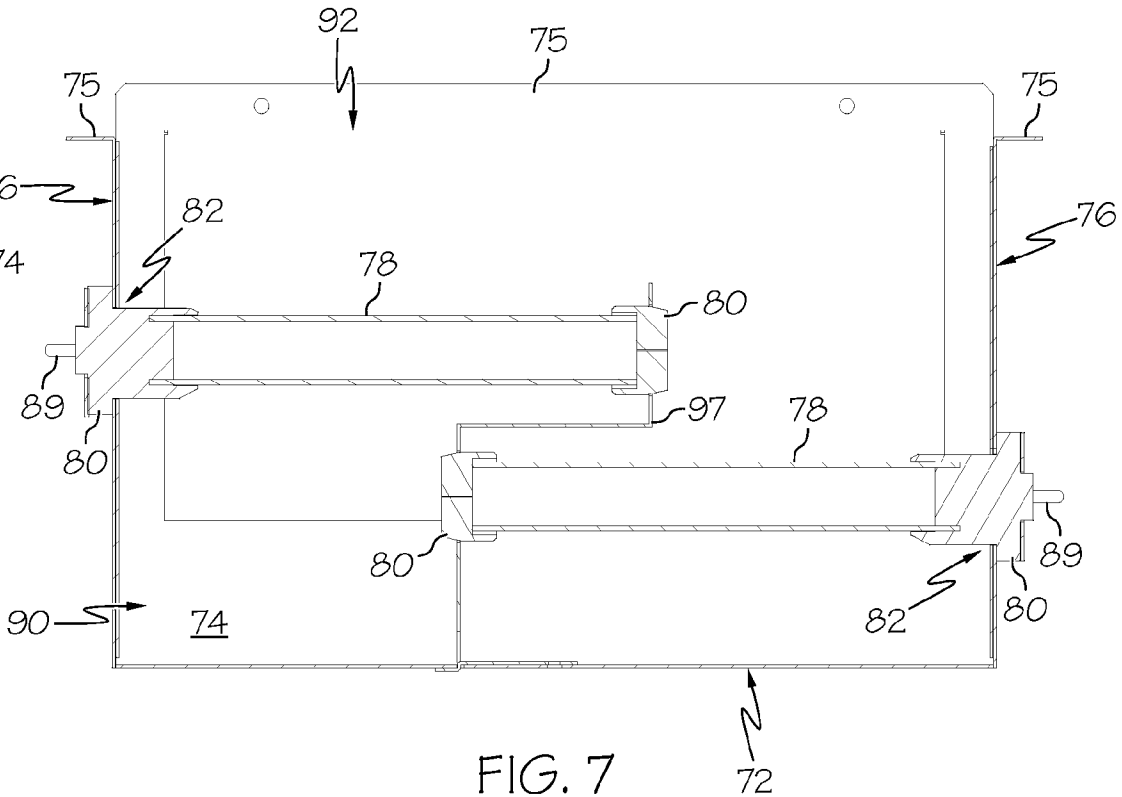
FIG. 7 is a side sectional view taken along line 7-7 of FIG. 6.
Figure 6:
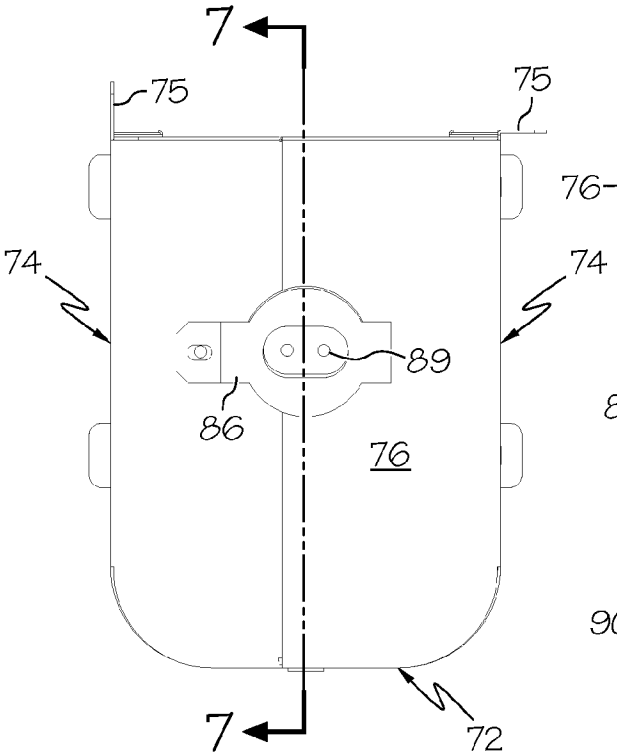
FIG. 6 is side view of the air conditioning core of FIG. 4.

As shown in FIG. 7, the air conditioning core 16 can include a plurality of sources of thermal energy 78. Due to space constraints, each of the energy sources 78 can be arranged in a staggered formation. For example, the energy sources 78 can be vertically staggered so as to permit all of the energy sources 78 to be horizontally centered along the end walls 76. The bracket 97 can be adapted accordingly. Moreover, the energy sources 78 can at least partially overlap each other such that the air passing through the air conditioning core and along the primary airflow pathway is heated by the plurality of energy sources 78.

Figure 5:
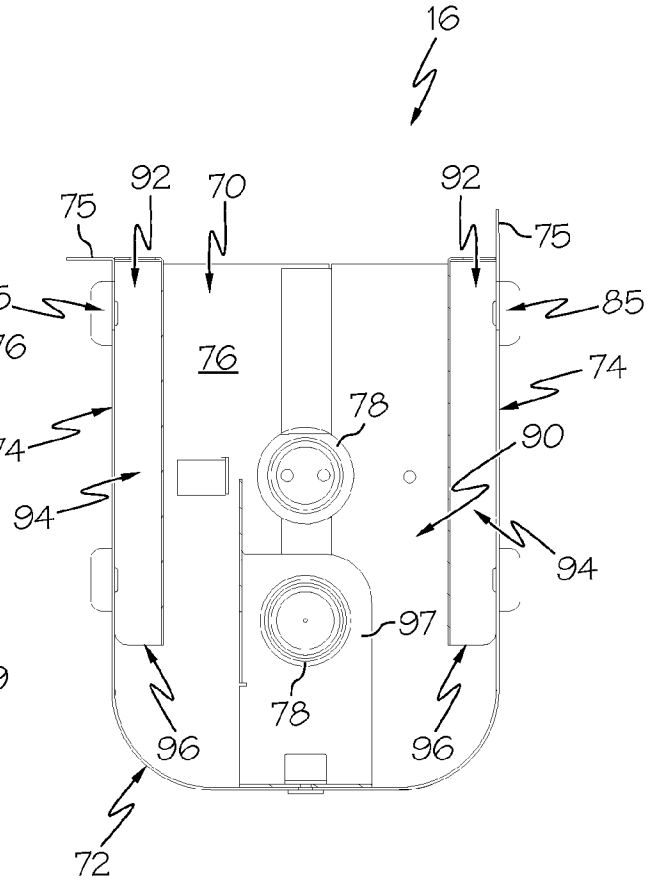
FIG. 5 is a side sectional view taken along line 5-5 of FIG. 4.
Figure 4:
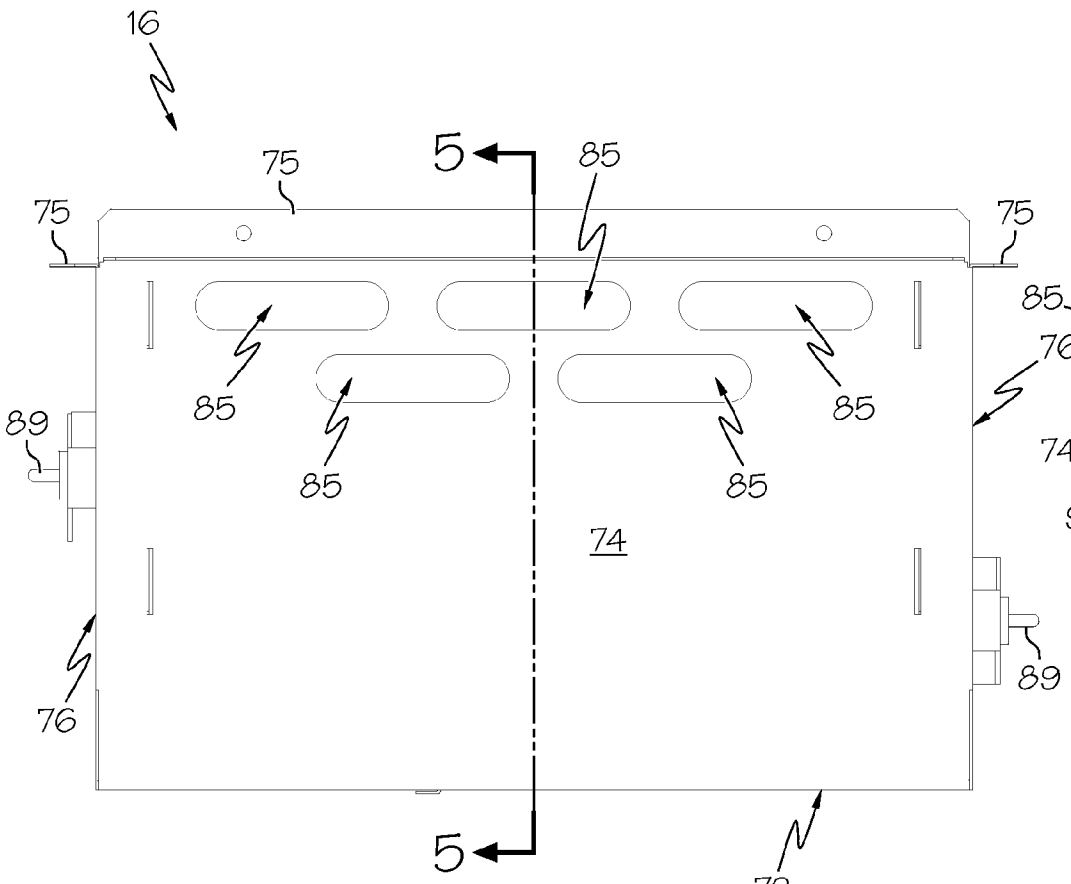
FIG. 4 is front view of an example air conditioning core.

The interchangeable air conditioning core 16 can be provided as a heat exchanger to increase the effectiveness of the plurality of energy sources 78. For example, the air conditioning core 16 is preferably in the form of a sheet of metal and fashioned into an enclosure around all of the sources of thermal energy source 78. Various metals can be used, such as steel, copper or aluminum that may or may not be pretreated. In one example, the air conditioning core 16 can include an inner duct 90 and an outer duct 92. As shown in FIG. 5, the inner duct 90 is disposed adjacent and surrounding the source(s) of thermal energy 78. The inner duct 90 is generally defined by the open top 70, curved bottom wall 72, side walls 74, and end walls 76. The inner duct 90 is further bounded by the outer duct(s) 92.

One or more outer ducts 92 can be provided. The outer duct(s) 92 are in fluid communication with the apertures 85 extending through the side walls 74, such that air passing from the intake chamber 62 into the air plenum 63 passes through the apertures 85 and first through the outer duct 92 before entering the inner duct 90. Thus, the outer duct 92 defines an intermediate pre-heating chamber 94 between the air plenum 63 and the inner duct 90. The outer duct(s) 92 can be formed by a metal casing enclosing the pre-heating chamber 94 while providing an outlet 96 at a lower end. The outer duct 92 can be coupled to the side walls 74 in various manners, such as with sheet metal screws and/or by other conventional methods of construction such as welding, brazing and the use of fasteners, such a projection received in a slot, or combinations of methods as known in the art. The length of the outer duct 92 is generally shorter than the overall length of the side wall 74 such that there is a gap between the outlet 96 and the generally curved bottom wall 72 such that air exhausted from the outer duct 92 strikes the bottom wall 72 and is directed upwards past the sources of thermal energy 78. For example, as shown in FIG. 2, such an arrangement of the inner and outer ducts 90, 92 can create a serpentine, circuitous "S"-shaped path for the airflow when viewed in cross-section.

In addition or alternatively, the bracket 97 supporting the energy sources 78 can be adapted to direct the airflow, such as to impart a swirling motion to the air passing through the inner duct 90 and around the energy sources 78. Upon being energized, energy sources 78 emit heat rays which are absorbed and reemitted by the inner and outer ducts 90, 92 into the passing air. In addition or alternatively, the air conditioning apparatus described above can further increase the overall efficiency by positioning the energy sources 78 very close to the air outlet 32, such that air heated by the energy sources 78 flows directly through open top 70 and out of the air outlet 32, with little if any intermediate structure therebetween.

The outer duct 92 can be formed of various materials, though a material with a relatively higher heat transfer coefficient is preferable. When the outer duct 92 is formed of copper material, the copper can be pretreated at temperature and for a time sufficient to soften the copper material and to partially blacken the surface of the copper material. In an example embodiment, the outer duct 92 can be formed from sheet copper having a thickness of 0.0216 inch and an oxygen content of 0.028% by weight. The outer duct 92 can be heated in an oven under ambient conditions for several hours at a temperature from about 850 degrees F. to about 900 degrees F. Any loose blackened material is removed by dry brushing. In one example, the outer duct 92 can be heated for two hours at a temperature between about 850 degrees F. and 875 degrees F., after which outer duct 92 is dry brushed and then further heated for one hour at 425 degrees F. It is believed that equally good results would be obtained when outer duct 92 is heated for three hours at 875 degrees F. and then dry brushed to remove any loose particles. Removal of loose particles prevents them from being discharged when the air conditioning apparatus 10 is first operated. Pretreatment of the copper can improve the heat efficiency of air conditioning apparatus by increasing the absorptivity and emissivity of the outer duct 92 and roughening the walls thereof for more turbulent air flow. Optionally, the aforementioned copper composition and heat treatment may also be applied to interior of the inner duct 90. Still, some or all of the copper material may not be pretreated.

When the outer duct 92 is formed of aluminum material, the aluminum can be pretreated by anodizing. During the anodizing process, a clear film of aluminum oxide is laid down on the aluminum's surface. For use in the air conditioning apparatus 10, the outer duct 92 is electrolytically colored a dark color to improve the material's radiant-heat properties, i.e., absorptivity and emissivity. It will be understood that the inner duct 90 may also be electrolytically colored. Still, either or both of the inner and outer ducts 90, 92 (or even additional elements) can be formed from various other materials, such as various metals (e.g., steel), ceramics, etc. that may or may not be pretreated.

As shown in FIG. 2, the arrangement of the air conditioning core 16 within the air plenum 63 forces air to be conditioned by moving along the primary air pathway to proceed through the inner and outer ducts 90, 92. For example, cool air is first drawn into the intake chamber 62, passes into the air plenum 63, through the apertures 85 and the outer duct 92 and into the intermediate pre-heating chamber 94 to be pre-heated. The air then passes through the outlet 96 and is further heated by passage around the plurality of sources of thermal energy 78. The heated air then proceeds through the open top 70 and through the dividing wall 81 to be exhausted out of the air outlet 32. Thus, the primary air pathway progressing through the air conditioning apparatus 10 can include some or all of the following to progress from the air inlet 30, to the intake chamber 62 and air plenum 63, through the apertures 85 and inner and outer ducts 90, 92 of the air conditioning core 16, along the length of the thermal energy source 78, through the open top 70 and dividing wall 81, and out the air outlet 32.

Additionally, air also travels simultaneously by moving along the independent secondary air pathway by proceeding into the intake chamber 62 and through the air plenum 63. The air then moves through the opening 120 into the air jacket 57 to further keep the exterior case 12 and cabinet relatively cool, and finally through the other opening 122 to be exhausted out of the aperture 124 adjacent the air outlet 32. Thus, the independent secondary air pathway progressing through the air conditioning apparatus 10 can include some or all of the following to progress from the air inlet 30, to the intake chamber 62 and air plenum 63, through the opening 120 and into the air jacket 57, through the opening 122 and out the aperture 124 and/or air outlet 32.

In addition or alternatively, an auxiliary thermal energy source, such as an infrared emitter (not shown), may be mounted adjacent front wall 18 of exterior case 12 and front mounting panel 52 below air outlet 32. The auxiliary energy source can boost the temperature of the air passing out of air conditioning apparatus through air outlet 32. In addition, radiation from the auxiliary energy source can be reflected by copper deflector shield 60 to provide a comforting warm glow seen through grille 34 over air outlet 32. It should be understood that deflector shield 60 may also be formed of pretreated copper or aluminum but the glow through grille 34 may be somewhat compromised. In one embodiment of air conditioning apparatus, auxiliary energy source can be a 250 watt quartz heating tube or other wattage.

In one example operation, thermostatic control 50 switches on energy sources 78 (and auxiliary heater, if present) whenever the temperature within the environment monitored by the thermostat drops below a predetermined minimum. Power is also supplied to fan 66 causing the fan to be activated. When control temperature sensor 67 is provided, activation of fan 66 may be delayed until the temperature in air conditioning core 16 has risen to a selected temperature. This is done so that the air coming from air conditioning apparatus is warm on startup.

A single air conditioning apparatus as described can effectively heat up to 500 square feet, or even more, and is capable of safely increasing the temperature of the air drawn through the unit by approximately 120 degrees F. It is believed the thermal efficiency of air conditioning apparatus is affected by pretreatment of the inner and outer ducts 90, 92. In the embodiments described above, it is believed the air conditioning apparatus is more thermally efficient than a space heater without pretreatment. It is further believed that this improvement results more heat from the same amount of power used. Other efficiencies may result from stripping residual heat from air conditioning core 16 on shut down with high temperature limit switch and from the pathway of the air through inner and outer ducts 90, 92 which can increase the dwell time of the air in air conditioning core 16. It will be apparent that other design features discussed above also contribute to the space heater's thermal efficiency.

Figure 8:
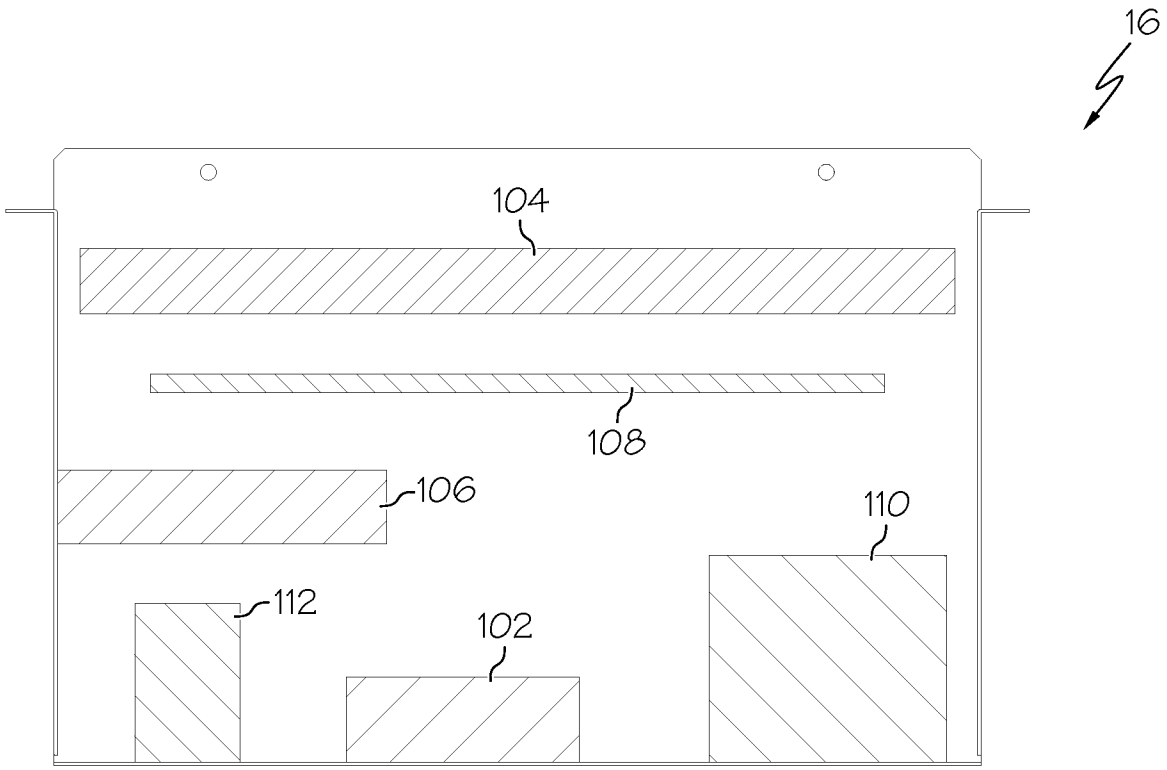
FIG. 8 is similar to FIG. 7, but shows another example air conditioning core.

Turning now to the example shown in FIG. 8, the air conditioning apparatus 10 can include a wide variety of air conditioning devices configured to condition (i.e., heat, cool, humidify, purify, etc.) air in various manners. Various non-limiting examples will be described. It is understood that the air conditioning apparatus 10 can include various numbers and/or combinations of air conditioning devices. Multiple air conditioning apparatuses 10 can also be utilized together to achieve a desired effect. For clarity, the various air conditioning devices shown in FIG. 8 are illustrated schematically within the air conditioning core 16.

In various examples, the air conditioning device can include an air heater (similar to the source of thermal energy 78 discussed herein, or even other types of air heaters). The air conditioning device can also include an air cooler 102, such as a conventional compressor-driven cooler or piezoelectric cooler. Where an air cooler 102 is provided, the air conditioning core can include supporting structure such as a compressor, condenser, evaporator, water drain, etc.

In another example, the air conditioning device can include at least one air filter 104 adapted to at least partially filter the air passing through the air conditioning core 16. Various filters can be used, such as paper, foam, cotton, HEPA, electrostatic, activated-carbon, etc. The filter 104 can be a single-use disposable item, or can also be cleanable and non-disposable.

In yet another example, the air conditioning device can be a source 106 of ultraviolet (UV) radiation to facilitate purifying the air passing through the air conditioning core 16. The source 106 of UV radiation can be used alone, or in combination with a photocatalyst 108. Photocatalytic air purification occurs when airborne contaminants physically touch a catalyst in the presence of UV light. The molecules of pollutants, odors, volatile organic compounds (VOCs), and/or biological contaminants (e.g., mold spores, bacteria, viruses, etc.) that come in contact with the photocatalyst are reconfigured into non-toxic elements. Ultraviolet radiation sources having an emission wavelength of about 180 nm to about 450 nm are preferred. It can be beneficial to utilize a source 106 of ultraviolet radiation that has germicidal emission wavelength equal to or greater than about 254 nm to avoid generating ozone (or an insignificant amount of ozone), and/or an accumulation of undesirable substances on the photocatalyst 108.

In yet another example, the air conditioning device can include a humidifier 110 that can utilize a water supply (not shown) to modify the relative humidity of the air passing through the air conditioning apparatus 10. For example, the humidifier can relatively increase the humidity in the air stream. Various types of humidification can be utilized, including hot and cold methods of increasing humidity in the air stream. The humidifier 110 can utilize a re-fillable water supply or could even be connected to a constant water supply line. Additionally, the humidifier 110 could be provided with a water drain, catch basin, etc. that can have a fixed volume or discharge hose. It is further contemplated that humidifier can relatively decrease the humidity in the air stream. A conventional compressor-driven cooler dehumidification system, or other similar types, can be used.

In still yet another example, the air conditioning device can include an ion generator 112 (e.g., a negative ion generator or the like) that uses relatively high voltage to ionize (electrically charge) air molecules. Airborne particles are attracted to the electrode in an effect similar to static electricity to remove such airborne contaminants from the air stream. The ion generator 112 can include a replaceable filter media or the like.

Though not shown, the air conditioning core 16 can further provide various supporting structures for the different air conditioning device, such as interconnecting ducting, dampers/valves, water inlets/outlets, power supplies, etc. Additionally, the various air conditioning devices can be secured to the various walls or surfaces, or can be retained by various brackets, etc.

In addition to the foregoing, the air conditioning apparatus 10 can include additional sterilizing, anti-bacterial, and/or deodorizing conditioning of the air flow. The sterilizing, antibacterial, and/or deodorizing feature can be used in addition or as an alternative to any of the air conditioning devices. In one example, various portions of the air conditioning apparatus 10 can be coated with sterilizing, antibacterial, and/or deodorizing coating(s) to provide such additional conditioning of the air flow. Sterilizing, antibacterial, and/or deodorizing coating(s) can be applied about the air inlet 30 or air outlet 32, such as to portions of the adjacent front or rear walls 18, 20. For example, the coatings could be applied to one or more faces of the grille 34 placed over the air outlet 32, or even the intake grate/grille about the air inlet 30. In another example, the filter 42 arranged about the air inlet 30 can include the coating. The coatings could even be applied to interior surfaces that contact the air flow (e.g., primary and/or secondary air pathways), such as within the air plenum 63, air conditioning core 16, and/or air jacket 57, etc.

Various sterilizing, antibacterial, and/or deodorizing coatings can be utilized. For example, the coatings can contain silver, titanium oxide and/or copper, though other elements can also be used. In one example, nano-silver can be used that is a resin composition containing silver particles with a nanoparticle size. The sterilizing, antibacterial, and/or deodorizing coatings can be applied variously, such as via chemical deposition or wet coating.

However, coatings may wear off over time to reduce the sterilizing, antibacterial, and/or deodorizing effectiveness. For example, the filter 42 may be periodically removed from the air conditioning apparatus 10 for cleaning by the user. It can be beneficial to provide the coatings in such a fashion that they are long-lasting and resistant to being removed via physical contact and/or periodic cleaning, as well as being efficient and cost-effective for manufacturing (e.g., using relatively less nano-silver material). In one example, the nano-silver particles can be incorporated into a sprayable media, such as a UV-curable ink. The ink could be a relatively clear ink so as not to alter the outward appearance of the coated items, or could have various colors, surface features, etc. This modified UV-curable ink can then be sprayed or otherwise deposited onto the desired portions of the air conditioning apparatus 10, such as to the air inlet 32, air outlet 34 (e.g., grille 34), air plenum 63, air conditioning core 16, and/or filter 42. In particular, the ink can be sprayed onto and throughout the filter 42, which can be an open-cell foam or the like. Next, the coated item with the UV-curable ink can be exposed to UV radiation to thereby be permanently cured. Using this method, the nano-silver particles will be dispersed throughout the cured ink, which permits the silver particles to perform the sterilizing, antibacterial, and/or deodorizing function, while also protecting the silver particles from being removed over time.

It is understood that any portion of the air conditioning apparatus 10 can be provided with the sterilizing, antibacterial, and/or deodorizing coating. While the coating can be used to condition the air flow, similar coatings can also be applied to the various exterior surfaces of the air conditioning apparatus 10 that an end user may touch. For example, the coatings can be applied to the front wall 18, rear wall 20, top wall 22, side walls 26, 28, bottom wall 24, variable thermostatic control 50, exterior surfaces about the air inlet 30 or air outlet 32, or even other surfaces.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An air conditioning apparatus, comprising:

an exterior case comprising an air inlet and an air outlet;

an air plenum disposed within the exterior case in fluid communication with the air inlet and air outlet and defining a primary air pathway and an independent secondary air pathway;

a fan communicating with the air inlet for moving air through the air plenum;

an interchangeable air conditioning core removably installed within the air plenum and interposed between the air inlet and air outlet such that air moving along the primary air pathway is forced to proceed through the interchangeable air conditioning core; and an air jacket extending at least partially between the exterior case and the interchangeable air conditioning core, the air jacket being in fluid communication with the secondary air pathway, wherein air moving through the secondary air pathway does not pass through the interchangeable air conditioning core.

2. The air conditioning apparatus of claim 1, further comprising at least one air conditioning device arranged within the interchangeable air conditioning core such that air moving along the primary airflow pathway is conditioned by the at least one air conditioning device, wherein the least one air conditioning device is removable from the air plenum together with the interchangeable air conditioning core.

3. The air conditioning apparatus of claim 2, wherein the at least one air conditioning device comprises a source of thermal energy.

4. The air conditioning apparatus of claim 3, wherein the source of thermal energy is an infrared emitter.

5. The air conditioning apparatus of claim 3, wherein the interchangeable air conditioning core comprises a heat exchanger comprising an inner duct and an outer duct, the inner duct being disposed adjacent and surrounding the source of thermal energy.

6. The air conditioning apparatus of claim 5, wherein the outer duct defines an intermediate space between the air plenum and the inner duct.

7. The air conditioning apparatus of claim 3, further comprising a first temperature sensor located to sense the air temperature inside the air plenum, wherein the first temperature sensor is configured to disable operation of the source of thermal energy when the air temperature in said air plenum exceeds a first predetermined temperature.

8. The air conditioning apparatus of claim 7, further comprising a second temperature sensor located to sense the air temperature inside the air plenum, wherein the second temperature sensor is configured to disable operation of the source of thermal energy when the air temperature in said air plenum exceeds a second predetermined temperature that is greater than the first predetermined temperature.

9. The air conditioning apparatus of claim 8, wherein the first and second temperature sensors are electrically arranged in series.

10. The air conditioning apparatus of claim 8, wherein the second temperature sensor is a single-use fuse.

11. The air conditioning apparatus of claim 2, wherein the at least one air conditioning device comprises an air filter.

12. The air conditioning apparatus of claim 2, wherein the at least one air conditioning device comprises a source of ultraviolet radiation.

13. The air conditioning apparatus of claim 12, further comprising a photocatalyst.

14. The air conditioning apparatus of claim 2, wherein the at least one air conditioning device comprises a humidifier.

15. The air conditioning apparatus of claim 2, wherein the at least one air conditioning device comprises an ion generator.

16. An air conditioning apparatus, comprising:

an exterior case comprising an air inlet and an air outlet;

an air plenum disposed within the exterior case in fluid communication with the air inlet and air outlet and defining a primary air pathway;

a fan communicating with the air inlet for moving air through the air plenum;

an interchangeable air conditioning core removably installed within the air plenum and interposed between the air inlet and air outlet such that air moving along the primary air pathway is forced to proceed through the interchangeable air conditioning core; and a removable access panel defining at least a portion of the air plenum, wherein an interior of said interchangeable air conditioning core is accessible by removing the access panel;

said removable access panel being coupled to the interchangeable air conditioning core such that removal of the removable access panel causes removal of the interchangeable air conditioning core from said air plenum.

17. The air conditioning apparatus of claim 16, wherein the air plenum further defines a secondary air pathway.

18. The air conditioning apparatus of claim 17, further comprising an air jacket extending at least partially between the exterior case and the interchangeable air conditioning core, the air jacket being in fluid communication with the secondary air pathway.

19. The air conditioning apparatus of claim 16, further comprising at least one air conditioning device installed within the interchangeable air conditioning core such that air moving along the primary airflow pathway is conditioned by the at least one air conditioning device, wherein the least one air conditioning device is removable from the air plenum together with the interchangeable air conditioning core.

20. The air conditioning apparatus of claim 19, wherein the at least one air conditioning device comprises a source of thermal energy.

21. The air conditioning apparatus of claim 20, further comprising first and second temperature sensors located to sense the air temperature inside the air plenum, wherein the first temperature sensor is configured to disable operation of the source of thermal energy when the air temperature in said air plenum exceeds a first predetermined temperature, and the second temperature sensor is configured to disable operation of the source of thermal energy when the air temperature in said air plenum exceeds a second predetermined temperature that is greater than the first predetermined temperature.

22. An air conditioning apparatus, comprising:

an exterior case comprising an air inlet and an air outlet;

an air plenum disposed within the exterior case in fluid communication with the air inlet and air outlet and defining a primary air pathway;

a fan communicating with the air inlet for moving air through the air plenum;

an interchangeable air conditioning core removably installed within the air plenum and interposed between the air inlet and air outlet such that air moving along the primary air pathway is forced to proceed through the interchangeable air conditioning core; and a plurality of sources of thermal energy installed within the interchangeable air conditioning core such that air moving along the primary airflow pathway is heated by the plurality of sources of thermal energy, wherein the plurality of sources of thermal energy are removable from the air plenum together with the interchangeable air conditioning core.

23. The air conditioning apparatus of claim 22, wherein each of the plurality of sources of thermal energy comprises an infrared emitter.

24. The air conditioning apparatus of claim 22, wherein the interchangeable air conditioning core comprises a heat exchanger comprising an inner duct and an outer duct, the inner duct being disposed adjacent and surrounding the plurality of sources of thermal energy.

25. The air conditioning apparatus of claim 24, wherein the outer duct defines an intermediate pre-heating chamber between the air plenum and the inner duct.

26. The air conditioning apparatus of claim 22, further comprising an air jacket extending at least partially between the exterior case and the interchangeable air conditioning core, the air jacket being in fluid communication with an independent secondary air pathway of the air plenum.

27. The air conditioning apparatus of claim 22, further comprising first and second temperature sensors located to sense the air temperature inside the air plenum, wherein the first temperature sensor is configured to disable operation of the source of thermal energy when the air temperature in said air plenum exceeds a first predetermined temperature, and the second temperature sensor is configured to disable operation of the source of thermal energy when the air temperature in said air plenum exceeds a second predetermined temperature that is greater than the first predetermined temperature.

28. The air conditioning apparatus of claim 27, wherein the first and second temperature sensors are electrically arranged in series.

29. The air conditioning apparatus of claim 27, wherein the second temperature sensor is a single-use fuse.

* * * * *